United States Patent [19]

Bourguignon

[11] 4,128,920

[45] Dec. 12, 1978

[54] MAGNETIC CLOSURE DEVICE

[76] Inventor: Ludwig Bourguignon, Bernauerstrasse 75, 8210 Prien a. Ch., Fed. Rep. of Germany

[21] Appl. No.: 767,736

[22] Filed: Feb. 11, 1977

Related U.S. Application Data

[62] Division of Ser. No. 616,041, Sep. 23, 1975, abandoned.

[51] Int. Cl.[2] ..... A44B 21/00

[52] U.S. Cl. ..... 24/201 B; 24/116 A

[58] Field of Search ..... 24/201 B, 201 A, 201 L, 24/73 MS, 116 A, 222 R; 70/457

[56] References Cited

U.S. PATENT DOCUMENTS

| | | | |
|---|---|---|---|
| 2,302,741 | 11/1942 | Carlile | 24/116 A |
| 2,389,298 | 11/1945 | Ellis | 24/201 B |
| 3,376,616 | 4/1968 | Kaczorowski | 24/201 B |

FOREIGN PATENT DOCUMENTS

| | | | |
|---|---|---|---|
| 538979 | 3/1932 | Fed. Rep. of Germany | 24/116 A |
| 1248047 | 10/1959 | France | 24/116 A |

*Primary Examiner*—Kenneth J. Dorner

*Attorney, Agent, or Firm*—W. G. Fasse; W. W. Roberts

[57] ABSTRACT

The present magnetic closure device has one or more holding members and one or more closure members, each with a surface configuration providing an increased frictional force, when two matching surface configurations cooperate. One member is made of permanent magnetic material, while the other member is made of ferromagnetically soft material. The increased frictional force and the magnetic force combine to provide an effective closure device for articles of non-magnetic material, such as leather goods, textiles, and synthetic materials.

7 Claims, 5 Drawing Figures

MAGNETIC CLOSURE DEVICE

CROSS REFERENCE TO RELATED APPLICATION

The present application is a divisional application of my copending application Ser. No. 616,041, filed: Sept. 23, 1975, now abandoned.

BACKGROUND OF THE INVENTION

The present invention relates to a magnetic closure device, especially for articles of non-magnetic materials, such as leather goods, textiles, synthetic materials, and so forth.

Closure devices of various kinds and useful for non-magnetic articles are known in large numbers. The so called slide closure devices including various kinds of zippers are to be mentioned in this respect. Further, so called rotary closure devices are also well known, whereby the latter are mainly used in connection with briefcases and the like.

Tension and pressure responsive closure means capable of taking up larger forces are also well known. Strapping closure devices belong in this group and are preferably used in connection with ski boots. In addition there are buckle closure devices for belts and shoes. Especially the latter are well known in numerous embodiments.

Most of the known closure devices, especially the zipper type of closures require numerous individual parts which can be closed or opened only by applying more or less force resulting in a respective wear and tear. Another disadvantage of known closure devices is seen in their relatively limited adjustability. Thus, especially briefcase closure devices normally have only one closing position. Another disadvantage of prior art devices is seen in the substantial costs for the manufacturing of a large number of individual parts and assembling such parts, whereby the production of the individual parts also requires a substantial capital investment for machinery and tools. A further drawback of prior art devices is seen in the fact that they are prone to failure, since it is unavoidable that individual parts may break easily, because due to weight considerations such parts are of a rather light construction. Furthermore, especially those embodiments of the prior art which require a substantial number of links and levers and so forth are also prone to failure, because these links and levers may easily be damaged or bent or even broken.

German Patent Publication No. 1,760,095 discloses a shoe closure device especially for ski boots, which is provided with a magnetic safety catch. Such a safety catch comprises two interlocking closure members provided with permanent magnets having plane surfaces contacting each other. The pulling or tension forces tending to separate the closure members are taken up solely in a mechanical manner by the steep serrated flanks of the closure members. Practical experience has shown that this type of closure device results in an increased pressure, especially along the edges of the closure device and such pressure is transmitted to the foot or the ankle of the person wearing such boots. Another drawback is seen in that for closing the two closure members a substantial stretching of the boot uppers is necessary to a position extending even beyond the closure position, because the serrated flanks must be relatively large for this purpose. This stretching is especially required where the ski pole or rather its tip is used for the closing. Thus, the shoe uppers may easily be damaged by the ski pole tip and the serrated flanks of the closure members are subject to rapid wear.

OBJECTS OF THE INVENTION

In view of the above, it is the aim of the present invention to achieve the following objects singly or in combination:

- to provide a magnetic closure device which avoids the disadvantages of the prior art as outlined above and which may be manufactured at low costs and relatively little capital investment;
- to provide a magnetic closure device of relatively low weight;
- to combine in a magnetic closure device the magnetic and mechanical features in such a manner that an extensive stretching during the closing itself is substantially reduced or altogether avoided;
- to provide a magnetic closure device which is versatile and useful in many different applications to operate in the form of a zipper and even in the form of a button and/or snap button; and
- to provide a closure device which may be used for shoes, bags, belts, clothing, as well as for watchbands, safety belts, shoe and boot buckles including mountaineer boots and ski boots and many other applications, for example, briefcases and suitcases.

SUMMARY OF THE INVENTION

The above objects have been achieved according to the invention by a magnetic closure device comprising a holding member and a closure member, one of which is made of permanent magnetic material and the other of which is made of ferromagnetically soft material. The holding member and the closure member are provided with profiled cooperating surfaces or surface portions of such a shape that a quasi-magnetic translation is accomplished. Due to the combination of the magnetic holding force with the frictional forces, which are increased by the magnetic holding force and the magnetic instability force, a substantial closure force is accomplished which opposes the pulling or tension force tending to separate the holding member from the closure member. The surface area of one of the members may be relatively small as compared to the given surface area of the other member. The configurations of the surface areas have preferably contrary, but matching shapes.

It is a particular advantage of the closure device according to the invention that it obviates all, or substantially all mechanical elements which heretofore have been necessary to provide a strapping or clamping action. Further, within the practical considerations, there are no limits in selecting the proper size of the present closure device for any particular requirements. The present closure device is rather variable in its adjustability and any number of adjustable steps may be selected to provide for a substantially continuous adjustability. The permanent holding magnet is employed with an optimal efficiency and it is not used as a safety latch against undesired opening, rather it forms part of the closure itself.

It is an essential further feature of the invention that due to the particular shape of the cooperating surface configurations, the pulling or tension force tending to separate the two surfaces extends perpendicularly to the resulting surface normal, whereby the optimal closure safety is assured.

BRIEF FIGURE DESCRIPTION

In order that the invention may be clearly understood, it will now be described, by way of example, with reference to the accompanying drawings, wherein:

FIG. 1*a* illustrates a holding member with a plurality of substantially hemispherically shaped recesses adapted to receive or hold correspondingly shaped closure elements forming a chain;

FIG. 1*b* shows a chain of balls fitting into the recesses of the holding member shown in FIG. 1*a;*

FIG. 2*a* shows a holding member with substantially hemispherical recesses open toward two sides;

FIG. 2*b* illustrates a closure member with spherical closing elements arranged in closed loop chain formation for cooperation with the holding member of FIG. 2*a;*

FIG. 3 illustrates a magnetic closure device according to the invention in its closed condition with a single hemispherical recess and a ball chain as shown in FIG. 1*b.*

DETAILED DESCRIPTION OF EXAMPLE EMBODIMENTS

Figure 1A:
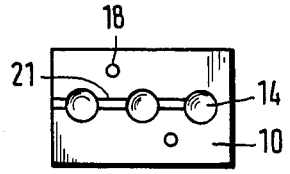
Figure 1B:
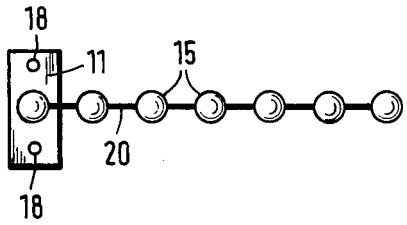

FIG. 1*a* illustrates a holding member 10 according to the invention. FIG. 1*b* illustrates a closure member 11. The holding member 10 is made of permanent magnetic material. A permanent magnetic material alloy comprising a rare earth metal, for example, samarium is suitable for the present purposes. Such permanent magnetic material alloys are well known in the art. The closure member 11 is made of a ferromagnetically soft material.

Preferably the permanent magnetic material holding member 10, and if desired also the closure member 11, are coated either entirely or partially with a coat of a synthetic material, for example, of the polyvinylchloride type (not shown). Further, the holding member 10 and closure number 11 may be provided with locating holes 18.

Incidentally, all the holding members will be designated by reference numeral 10, even if somewhat different surface configurations are illustrated. Similarly, all the closure members will be designated by the reference numeral 11, even if different surface configurations are involved.

Referring further to FIG. 1*a*, the holding member 10 has a surface configuration formed by a plurality of recesses 11 having a substantially hemispherical shape. Preferably, the hemispherical recesses 14 are interconnected by grooves 21. The corresponding closure member 11 shown in FIG. 1*b* comprises a plurality of spherical or hemispherical closure elements 15 interconnected by links 20 to form a chain. The embodiment illustrated in FIGS. 1*a* and 1*b* is also suitable for a wide range of adjustments. This embodiment also has the advantage that the ball chain adapts itself easily to the surface shape of the article to which the closure device is attached. Crosswise effective forces, that is, forces which are effective substantially perpendicularly to the longitudinal extension of the ball chain cannot be transmitted to the holding member 10. Therefore, the closing safety of the device according to FIG. 1*a* and FIG. 1*b* is rather effective. Still another advantage of the ball chain is seen in that the tearing open moment at the holding member 10 becomes zero. In addition, the surface matching between the spherical or hemispherical recesses and the spherical or hemispherical balls is very efficient so that the tensional forces tending to open the closure device are effective to increase the frictional forces. This type of closure device is suitable for transmitting small, as well as substantial forces depending on the size of the holding member 10, and the ball chain so that this embodiment could also be used, for example, for seat belts.

Incidentally, the holding member 10 of FIG. 1*a* and the closure member 11 of FIG. 1*b* are provided with the above mentioned holes 18 which serve for properly locating these members relative to the article to be closed, for example, a garment, whereby the members could be sewn to the garment through the holes 18. The holes may also be used for properly locating these members, for example, on a shoe upper, which is provided with respective matching holes.

Figure 2A:
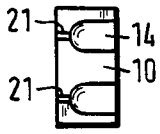
Figure 2B:
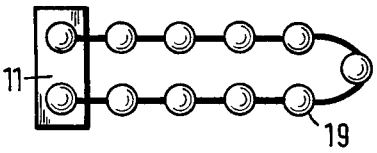

FIGS. 2*a* and 2*b* illustrate a modification of the embodiment shown in FIGS. 1*a* and 1*b*, whereby the holding member 10 of FIG. 2*a* is provided with two substantially hemispherical recesses 14 and with grooves 21. The closure member 11 of FIG. 2*b* carries a ball chain 19, whereby the links which interconnect the balls fit into the grooves 21, while the balls fit into the recesses 14. The ends of the ball chain 19 in FIG. 2*b* are interconnected forming a closed loop.

Figure 3:
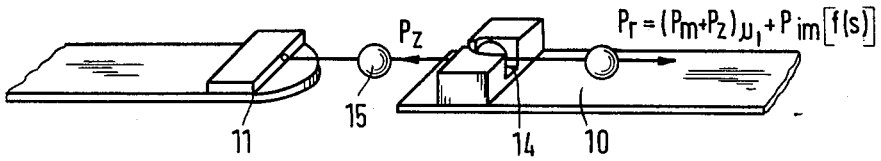

FIG. 3 illustrates in a somewhat schematic manner an embodiment of a closure device according to the invention in its closed condition, and comprising a holding member 10 with a hemispherical recess 14 open toward two order, and a closure member 11 with a ball chain 15. The pulling force Pz would normally tend to separate the members 10, 11 from each other. However, due to the special surface cooperation between the hemispherical recess and the closure balls, the pulling force increases the frictional force Pr as follows:

$$Pr = (Pm+Pz)\,\mu 1 + Pim\,[f(s)]$$

In the foregoing formula, Pm is the magnetic force of the permanent magnet of the member 10 in the direction of a normal N to the surface of the holding member 10; Pz is the pulling force tending to open the closure device; $\mu 1$ is the friction coefficient for sliding friction; Pim is the magnetic instability force; and f(s) is the function of the movement of the ball out of its normal closing position.

In the normal, closed condition the magnetic force Pm substantially causes the friction force Pr due to the static friction coefficient $\mu 0$, whereby Pr corresponds to: $Pr = Pm \cdot \mu 0$. As the device begins to open, the static friction coefficient changes to a gliding friction coefficient $\mu 1$ and in addition the magnetic instability force Pim becomes effective due to the shifting of the two members 10 and 11 relative to each other. Such magnetic instability force tends to restore the original closed condition and is effective in the direction of the contacting surfaces. At this instance the frictional force Pr becomes:

$$Pr = Pm \cdot \mu 1 + Pim\,[f(s)]$$

As a result this effect or rather this magnetic instability force contributes to the increase of the forces effective in tending to keep the device in the closed condition, such increase of the forces occurring in response to an attempt to open the device. This feature of the invention has the advantage that it increases the closing safety so that the closure device will automatically close itself again, if the frictional force is only exceeded momentarily and the applied momentary pulling force will contribute to the automatic closing.

In view of the foregoing disclosure, it will be appreciated that the present invention is suitable for closing many different items from garments, shoes and the like to briefcases, luggage and so forth.

Although the invention has been described with reference to specific example embodiments, it is to be understood, that it is intended to cover all modifications and equivalents within the scope of the appended claims.

What is claimed is:

1. A magnetic closure device which employs a magnetic closing force increased by a magnetic instability force, comprising a first closure member made of a permanent magnet and a second closure member made of an unmagnetized, magnetizable material, one of said closure members having a surface with a shaped recess forming a recess locking means therein, the other of said closure members comprising a plurality of correspondingly shaped fitting locking elements adapted to fit into said shaped recess locking means, and securing means operatively interconnecting said plurality of fitting locking elements to form a row of fitting locking elements, whereby the closure device is adjustable and closable by the engagement of a different one of said fitting locking elements with said recess locking means, whereby said magnetic closing force is increased by said magnetic instability force, wherein one of said closure members comprises two recesses arranged side by side, each recess being open toward two adjacent sides of said one closure member, two notches in said one closure member being arranged to reach into the respective recess from a further adjacent side of said one closure member, and wherein a plurality of shaped fitting locking elements of the other closure member are shaped to fit into said recesses, and means interconnecting said fitting locking elements in spaced relationship relative to each other to form a loop both ends of which are connected to the other closure member whereby portions of said interconnecting means extend through said notches when two locking elements are held in said two recesses.

2. The magnetic closure device of claim 1, wherein said shaped recess locking means comprise substantially hemispherically shaped recesses, and wherein a plurality of fitting locking elements comprise ball elements shaped to fit into said hemispherically shaped recesses.

3. The magnetic closure device of claim 1, wherein said shaped recess locking means comprise a plurality of shaped recesses arranged in a row, and wherein a plurality of respectively shaped fitting locking elements are interconnected to form a chain which in turn forms said loop.

4. The magnetic closure device of claim 3, wherein said shaped recesses have a hemispherical shape, wherein plurality of grooves interconnect said hemispherically shaped recesses in said row, wherein said fitting locking elements comprise a plurality of ball elements shaped to fit into said shaped recesses and link means connecting said ball elements in a chain, whereby said link means extend in said grooves in the locked position of the closure device.

5. The magnetic closure device of claim 1, wherein said permanent magnetic material is of the rare earth metal alloy type.

6. The magnetic closure device of claim 5, wherein said alloy comprises samarium.

7. The magnetic closure device of claim 1 wherein each of said locking elements constitutes at least a portion of a sphere.

* * * * *